US007471269B2

(12) United States Patent
Ushigusa et al.

(10) Patent No.: US 7,471,269 B2
(45) Date of Patent: Dec. 30, 2008

(54) METHOD FOR DRIVING ELECTROLUMINESCENCE DISPLAY PANEL WITH SELECTIVE PRELIMINARY CHARGING

(75) Inventors: Yoshihiro Ushigusa, Kanagawa-ken (JP); Makoto Kouno, Kanagawa-ken (JP); Eitaro Nishigaki, Kanagawa-ken (JP)

(73) Assignee: Samsung SDI Co., Ltd., Suwon (KR)

( * ) Notice: Subject to any disclaimer, the term of this patent is extended or adjusted under 35 U.S.C. 154(b) by 620 days.

(21) Appl. No.: 10/929,598

(22) Filed: Aug. 31, 2004

(65) Prior Publication Data

US 2005/0093769 A1 May 5, 2005

(30) Foreign Application Priority Data

Oct. 18, 2003 (KR) ..... 10-2003-0072790

(51) Int. Cl.
*G09G 3/30* (2006.01)

(52) U.S. Cl. ..... 345/76; 345/81

(58) Field of Classification Search ..... 345/3.2, 345/100, 87, 98, 76, 83, 55, 72, 79, 211, 345/208, 204, 104, 90, 66, 92, 206, 82, 690, 345/84, 94, 99, 212, 537, 1.1, 89, 81; 315/169.3, 315/172; 359/645; 349/43, 58, 117, 127, 349/129, 139; 361/151; 347/237, 238
See application file for complete search history.

(56) References Cited

U.S. PATENT DOCUMENTS 4,872,002 A * 10/1989 Stewart et al. ..... 345/55
4,914,353 A * 4/1990 Harada et al. ..... 315/169.3
4,963,860 A * 10/1990 Stewart ..... 345/206
5,686,935 A * 11/1997 Weisbrod ..... 345/100
6,307,681 B1 * 10/2001 Aoki et al. ..... 359/645
6,534,925 B2 * 3/2003 Kawashima ..... 315/169.1
6,753,881 B1 * 6/2004 Callway et al. ..... 345/699
6,888,557 B2 * 5/2005 Inoue et al. ..... 347/238
6,909,304 B2 * 6/2005 Takafuji et al. ..... 324/770
6,985,142 B1 * 1/2006 Svensson et al. ..... 345/211
6,989,826 B2 * 1/2006 Kasai ..... 345/204
6,995,737 B2 * 2/2006 LeChevalier ..... 345/82

(Continued)

FOREIGN PATENT DOCUMENTS

CN 1427385 7/2003

OTHER PUBLICATIONS

Chinese Office Action dated Feb. 15, 2008.

*Primary Examiner*—Prabodh M Dharia
(74) *Attorney, Agent, or Firm*—H.C. Park & Associates, PLC

(57) ABSTRACT

Provided is a method for driving an electroluminescence display panel in which data electrode lines and scan electrode lines cross each other with predetermined gaps to form electroluminescence cells in the crossing areas. The method includes performing a preliminary charging stage in which the signal input terminals of the data electrode lines are switched and electrically disconnected from a data driving unit, and the other terminals of the data electrode lines are switched and electrically connected to one another in the initial stage of each parallel driving period. The preliminary charging stage is performed in the following parallel driving period when the data of the present parallel driving period and the data of the following parallel driving period are different.

8 Claims, 7 Drawing Sheets

U.S. PATENT DOCUMENTS 7,049,756 B2 * 5/2006 Aiba et al. ..... 315/172
7,268,762 B2 * 9/2007 Kitagawa et al. ..... 345/98
7,274,345 B2 * 9/2007 Imamura et al. ..... 345/76
2001/0052887 A1 * 12/2001 Tsutsui et al. ..... 345/87
2002/0011994 A1 * 1/2002 Imamura ..... 345/204
2002/0036605 A1 3/2002 Kawashima ..... 345/76
2002/0097002 A1 * 7/2002 Lai et al. ..... 315/169.3
2003/0030602 A1 * 2/2003 Kasai ..... 345/76
2003/0128200 A1 * 7/2003 Yumoto ..... 345/211
2003/0151570 A1 * 8/2003 LeChevalier et al. ..... 345/84
2003/0173991 A1 * 9/2003 Takafuji et al. ..... 324/770
2003/0174199 A1 * 9/2003 Inoue et al. ..... 347/237
2004/0004590 A1 * 1/2004 LeChevalier ..... 345/82
2004/0056833 A1 * 3/2004 Kitagawa et al. ..... 345/92
2005/0156860 A1 * 7/2005 Kim et al. ..... 345/100
2005/0190177 A1 * 9/2005 Yumoto ..... 345/211
2005/0206606 A1 * 9/2005 Takafuji et al. ..... 345/100
2006/0071924 A1 * 4/2006 Svensson et al. ..... 345/204
2006/0114192 A1 * 6/2006 Kasai ..... 345/76

* cited by examiner

METHOD FOR DRIVING ELECTROLUMINESCENCE DISPLAY PANEL WITH SELECTIVE PRELIMINARY CHARGING

This application claims the benefit of Korean Patent Application No. 2003-72790, filed on Oct. 18, 2003, which is hereby incorporated by reference for all purposes as if fully set forth herein.

BACKGROUND OF THE INVENTION

1. Field of the Invention

The present invention relates to a method for driving an electroluminescence display panel, and more particularly, to a method for driving an electroluminescence display panel in which data electrode lines and scan electrode lines cross each other with predetermined gaps and electroluminescence cells are formed in line crossing areas.

2. Discussion of the Related Art

Referring to FIG. 1, a conventional electroluminescence display panel includes a display panel 2 and a driving device, which includes a control unit 21, a scan driving unit 6, and a data driving unit 5. Charging switches 25 and a charging voltage determiner 22 may be included in the electroluminescence display panel 2 or in the driving device.

Data electrode lines 3 and scan electrode lines 4 cross each other with predetermined gaps to form electroluminescence cells 1 in areas where the lines 3 and 4 cross.

The control unit 21 processes external image signals to input display data signals and switching control signals to the data driving unit 5 and switching control signals to the scan driving unit 6 and the charging switches 25. The scan driving unit 6 drives the scan electrode lines 4 in accordance with the switching control signals. The data driving unit 5 drives the data electrode lines 3 according to the switching control signals and display data signals.

The charging switches 25 electrically connect or disconnect the data electrode lines 3 according to the switching control signal. The charging voltage determiner 22, which comprises a capacitor 24 and a zener diode 23 connected in parallel, determines a preliminary charging voltage of the data electrode lines 3 by using the zener diode 23 breakdown voltage.

A conventional method for driving an electroluminescence display panel, such as that disclosed in U.S. published patent application of publication no. 2002/0036605 (Title of Invention: "Organic EL Display Device and Method for Driving the Same"), will now be described with reference to FIG. 1 and FIG. 2. In FIG. 2, PRE and PEAK denote preliminary charging signals and peak booting signals, respectively, that the control unit 21 outputs to the data driving unit 5, the scan driving unit 6, and the charging switches 25. $I_{Dm}$ and $V_{Dm}$ denote a current waveform and a voltage waveform, respectively, that flow through any one data electrode line to which a luminescence data voltage is applied in the parallel driving periods. $S_{Sn}$ is denotes the scan driving signal applied from the scan driving unit 6 to an n-scan electrode line. $S_{Sn+1}$ denotes the scan driving signal applied from the scan driving unit 6 to an (n+1)-scan electrode line.

Parallel driving periods T1, T2 include preliminary charging stages t1~t21 and t3~t41 and scan stages t21~t3 and t41~t5, respectively.

In the preliminary charging stage t1~t21 of the n-parallel driving period T1, the signal input terminals of the data electrode lines 3 are electrically disconnected from the data driving unit 5. In addition, scan switches 10*a* through 10*c* apply a second potential to the scan electrode lines 4 that prevents the electroluminescence cells 1 from emitting light. The charging switches 25 switch the other terminals of the data electrode lines 3 to be electrically connected to one another. Accordingly, parasitic capacitance of previously lit electroluminescence cells 1 in an (n−1)-scan electrode line is discharged, resulting in a higher data electrode line potential than a ground potential.

In the scan stage t21~t3 of the n-parallel driving period T1, the charging switches 25 electrically disconnect the other terminals of the data electrode lines 3 from one another. Additionally, the signal input terminals of the data electrode lines 3 are switched and electrically connected to the data driving unit 5. The ground potential, as a first potential lower than the second potential, is applied to the scan electrode line that will be scanned, and the second potential is applied to the other scan electrode lines. Additionally, data current signals are applied to the signal input terminals of the data electrode lines 3. In peak booting stage t21~t22 of the scan stage t21~t3, additional current signals are applied to the signal input terminals of the data electrode lines 3.

The same operation as described above is performed in the (n+1)-parallel driving period T2.

FIG. 3A illustrates the current flow in the preliminary charging stages t1~t21 and t3~t41 of FIG. 2. Referring to FIG. 1, FIG. 2 and FIG. 3A, current I1 flows from the electroluminescence cells 1 to ground through the charging switches 25 and the zener diode 23, and current I2 flows from a power source V1 in the data driving unit 5 to ground through the parasitic capacitance in the data driving unit 5, the charging switches 25, and the zener diode 23. Here, the potential at point A is the zener diode 23 breakdown voltage. Accordingly, the voltage between the power source V1 and the point A is the voltage of the power source V1 minus the zener diode 23 breakdown voltage.

FIG. 3B illustrates the current flow in the scan stage t21~t3 of FIG. 2. Referring to FIG. 1, FIG. 2, and FIG. 3B, current 14 flows from the power source V1 in the data driving unit 5 to ground through current sources 8 and the electroluminescence cells 1, and internal current 13 flows from the current sources 8 through the parasitic capacitance in the data driving unit 5. Here, the potential at point A is the terminal voltage of the electroluminescence cells 1. Accordingly, the voltage between the power source V1 and the point A is the voltage of the power source V1 minus the terminal voltage of the electroluminescence cells 1.

The data driving unit 5 of a conventional electroluminescence display panel will now be described with reference to FIG. 1 and FIG. 4.

The data driving unit 5 of a conventional electroluminescence display panel includes an (n+1)-data register 51, an n-data latch 52, a digital-analog converter 53, a booting circuit 54, and preliminary charging switches 55. The (n+1)-data register 51 receives data of the unit scan line 4*a*, 4*b*, or 4*c* from the control unit 21. The data stored in the n-data latch 52 is input to the digital-analog converter 53, and the data stored in the (n+1)-data register 51 is input to the n-data latch 52, based on parallel synchronous signals $H_{SYNC}$. In other words, the data of the present parallel driving period is stored in the n-data latch 52, and the data of the following parallel driving period is stored in the (n+1)-data register 51. The digital-analog converter 53 processes the data input from the n-data latch 52 to output current data signals corresponding to the data lines 3*a* through 3*e*. The booting circuit 54 amplifies the current data signals in the peak driving stages t21~t22 and t41~t42, based on the timing control signal PEAK. The preliminary charging switches 55 are turned off in the preliminary charging stages t1~21 and t3~t41 and turned on in the scan stages t21~t3 and t41~t5, based on the preliminary charging signal PRE.

Based on the conventional method, the data electrode line potentials are higher than the ground potential due to the preliminary charging stage t1~t21. Additionally, a brightness drop caused by the parasitic capacitance of the electroluminescence cells 1 may be prevented by applying additional current signals in the peak booting stage t21~t22. The parasitic capacitance of the non-scanned electroluminescence cells 1 has a reverse polarity, and the driving voltage increases slowly while scanning the electroluminescence cells 1, resulting in the drop in brightness. However, such operations must be repeated every parallel driving period, which results in higher power consumption.

SUMMARY OF THE INVENTION

The present invention provides a method for driving an electroluminescence display panel that prevents a drop in brightness caused by parasitic capacitance of electroluminescence cells and reduces power consumption.

Additional features of the invention will be set forth in the description which follows, and in part will be apparent from the description, or may be learned by practice of the invention.

The present invention discloses a method for driving an electroluminescence display panel in which data electrode lines and scan electrode lines cross each other with predetermined gaps to form electroluminescence cells in the crossing areas. The method includes performing a preliminary charging stage in which the signal input terminals of the data electrode lines are switched and electrically disconnected from a data driving unit, and the other terminals of the data electrode lines are switched and electrically connected to one another in the initial stage of each parallel driving period. The preliminary charging stage is performed in a following parallel driving period only when data of a present parallel driving period and data of the following parallel driving period are different. The present invention also discloses a data driving unit for an electroluminescence display panel, comprising a (n+1)-data register coupled to a n-data latch and a comparator, a digital to analog converter coupled to the n-data latch and the comparator, and a booting circuit coupled to the digital to analog converter. A preliminary charging switch is coupled to the booting circuit. The comparator outputs to an AND gate that outputs to the booting circuit and to the preliminary charging switches.

It is to be understood that both the foregoing general description and the following detailed description are exemplary and explanatory and are intended to provide further explanation of the invention as claimed.

BRIEF DESCRIPTION OF THE DRAWINGS

The accompanying drawings, which are included to provide a further understanding of the invention and are incorporated in and constitute a part of this specification, illustrate embodiments of the invention and together with the description serve to explain the principles of the invention.

DETAILED DESCRIPTION OF THE INVENTION

Figure 1:
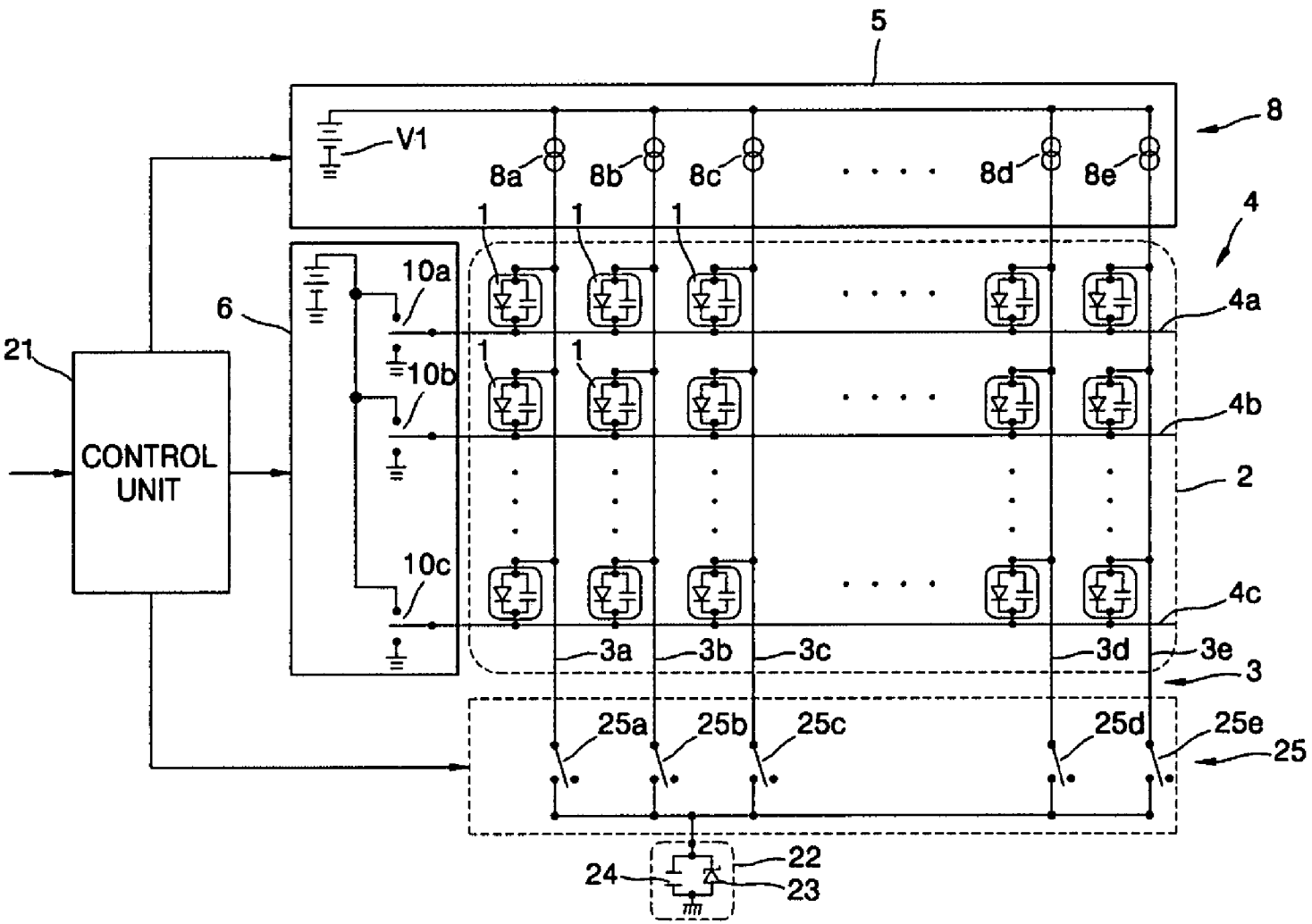
FIG. 1 (PRIOR ART)
FIG. 1 shows a conventional electroluminescence display panel structure.
Figure 2:
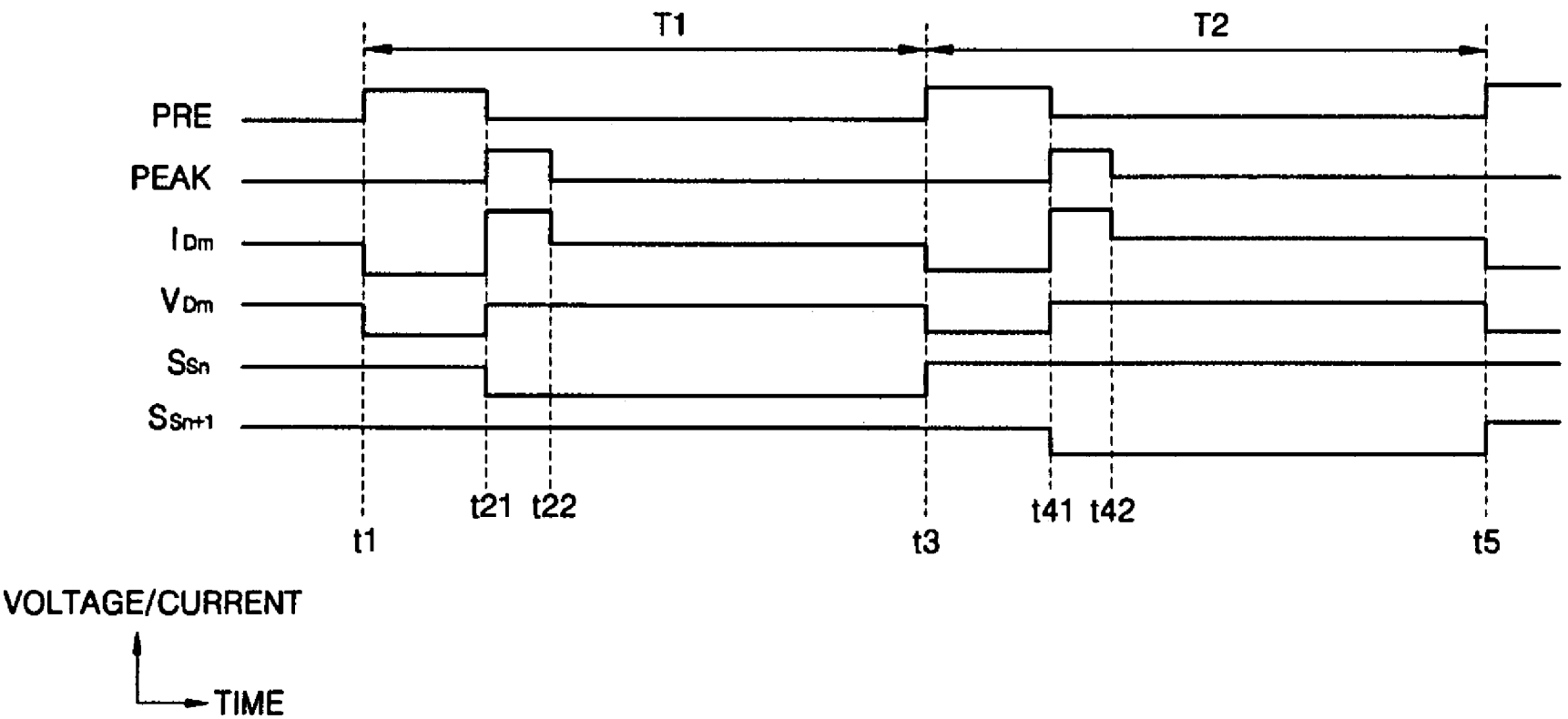
FIG. 2 (PRIOR ART)
FIG. 2 shows a timing diagram for a conventional method for driving the electroluminescence display panel of FIG. 1.
Figure 3A:
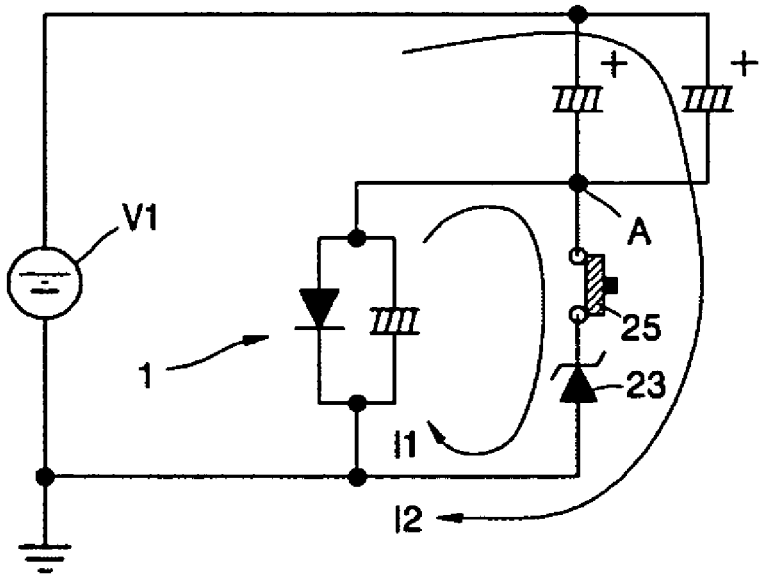
FIG. 3A (PRIOR ART)
FIG. 3A shows current flow in a preliminary charging stage of FIG. 2.
Figure 3B:
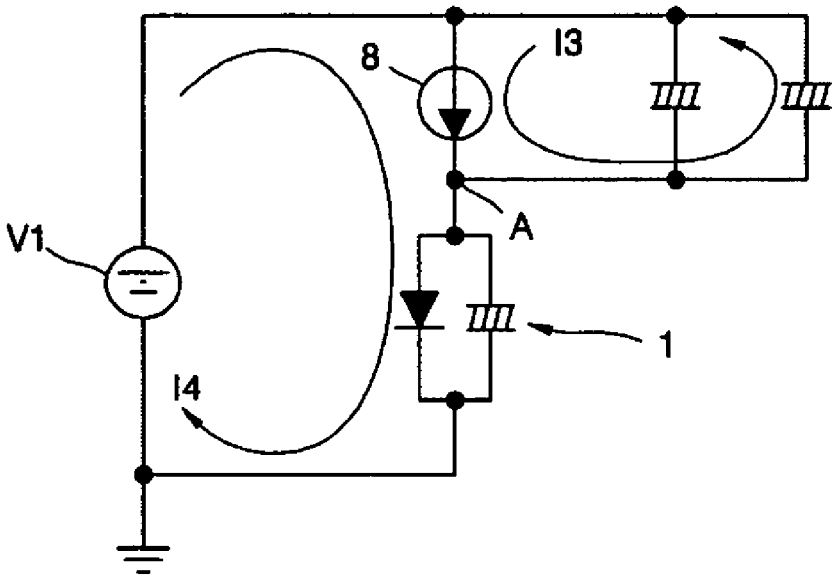
FIG. 3B (PRIOR ART)
FIG. 3B shows current flow in a scan stage of FIG. 2.
Figure 4:
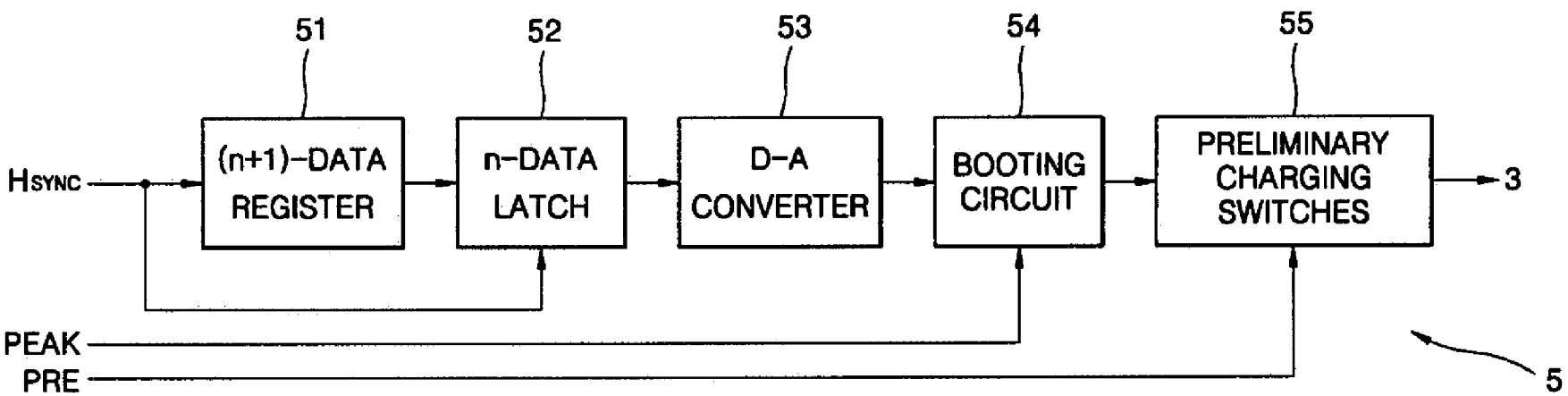
FIG. 4 (PRIOR ART)
FIG. 4 shows an internal structure of the conventional electroluminescence display panel of FIG. 1.
Figure 5:
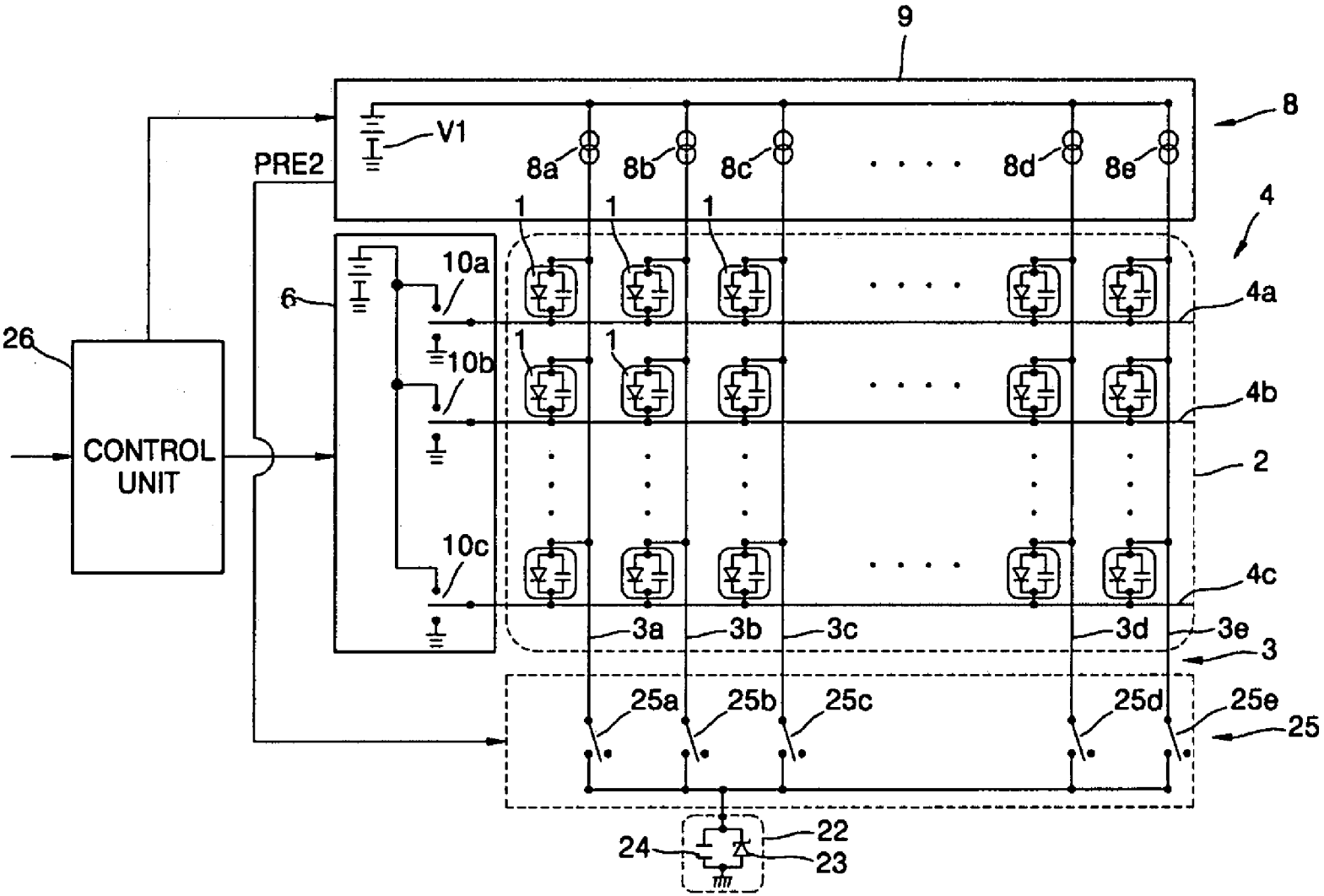
FIG. 5 shows an electroluminescence display panel according to an exemplary embodiment of the present invention.

Referring to FIG. 5, an electroluminescence display panel according to an exemplary embodiment of the present invention includes a display panel 2 and a driving device, which includes a control unit 26, a scan driving unit 6, and a data driving unit 9. Charging switches 25 and a charging voltage determiner 22 may be included in the electroluminescence display panel 2 or in the driving device.

Data electrode lines 3 and scan electrode lines 4 cross each other with predetermined gaps to form electroluminescence cells 1 in areas where the lines 3 and 4 cross.

The control unit 26 processes external image signals and outputs display data signals and switching control signals to the data driving unit 9 and switching control signals to the scan driving unit 6. The scan driving unit 6 drives the scan electrode lines 4 according to the switching control signal.

The data driving unit 9 drives the data electrode lines 3 according to the switching control signal and display data signal. Additionally, the data driving unit 9 controls internal preliminary charging switches and charging switches 25 with its output preliminary charging control signal PRE2, which is based on a difference between data of a present parallel driving period and data of a following parallel driving period.

The charging switches 25 electrically connect or disconnect the data electrode lines 3 according to the switching control signal. The charging voltage determiner 22, which includes a capacitor 24 and a zener diode 23 in parallel, determines a preliminary charging voltage of the data electrode lines 3 by using the zener diode 23 breakdown voltage.

Figure 6:
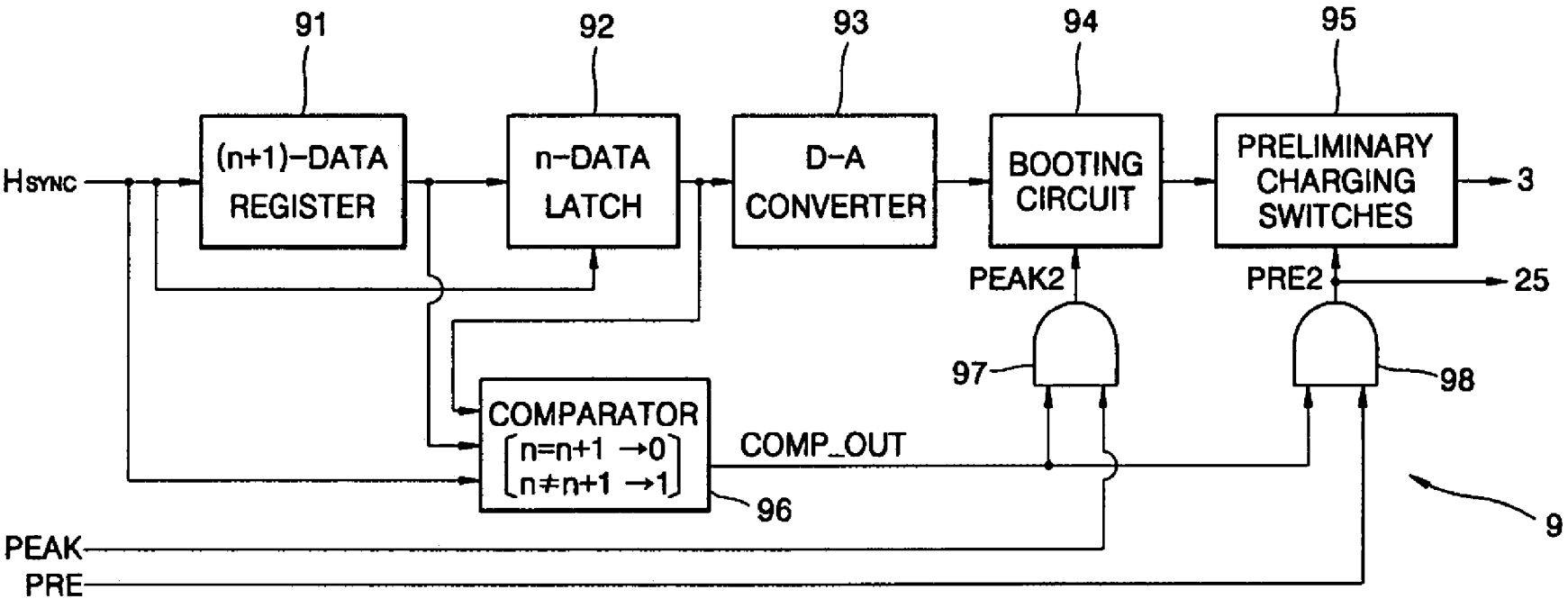
FIG. 6 shows an internal structure of the electroluminescence display panel of FIG. 5.

Referring to FIG. 6, the data driving unit 9 includes an (n+1)-data register 91, an n-data latch 92, a digital-analog converter 93, a booting circuit 94, preliminary charging switches 95, a comparator 96, and AND gates 97 and 98. The (n+1)-data register 91 receives data of the unit scan line 4*a*, 4*b*, or 4*c* from the control unit 26. Based on parallel synchronous signals $H_{SYNC}$, the data stored in the n-data latch 92 is outputted to the digital-analog converter 93, and the data stored in the (n+1)-data register 91 is outputted to the n-data latch 92. In other words, the present parallel driving period data is stored in the n-data latch 92, and the following parallel driving period data is stored in the (n+1)-data register 91. The digital-analog converter 93 processes the data from the n-data latch 92 to output current data signals corresponding to the data lines 3*a* through 3*e*. The booting circuit 94 increases the current of the input current data signals in the peak driving stage according to a peak-booting control signal PEAK2 from the first AND gate 97. The preliminary charging switches 95 are off in the preliminary charging stage and on in the scan stage based on a preliminary charging control signal PRE2 from the second AND gate 98.

Also, based on the parallel synchronous signal $H_{SYNC}$, the present parallel driving period data n from the n-data latch 92 and the following parallel driving period data n+1 from the (n+1)-data register 91 are inputted to the comparator 96. The comparator 96 outputs a signal COMP_OUT of logic "0" when the present parallel driving period data n and the following parallel driving period data n+1 are the same, and outputs the signal COMP_OUT of logic "1" when they are different. Thus, the first AND gate 97 outputs the peak booting control signal PEAK2 of logic "1" when the prior peak booting control signal PEAK and the output signal COMP_OUT are logic "1". Additionally, the second AND gate 98 outputs the preliminary charging control signal PRE2 of logic "1" when the prior preliminary charging control signal PRE and the output signal COMP_OUT are logic "1".

Figure 7:
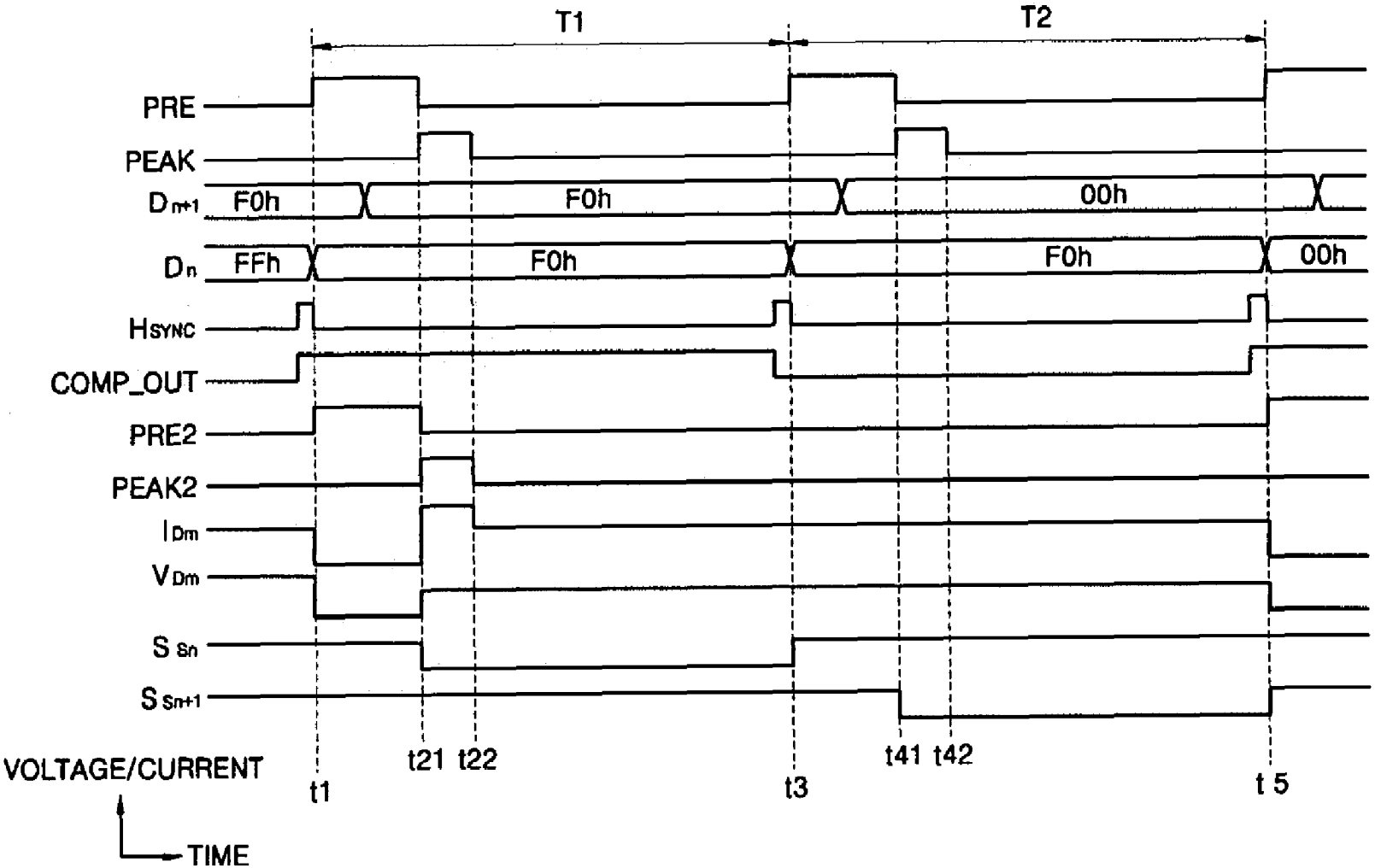
FIG. 7 shows a timing diagram for a data driving unit of FIG. 6 and the electroluminescence display panel of FIG. 5.

The relationship between the signals from the data driving unit 9 of FIG. 6 and the electroluminescence display panel 2 of FIG. 5 will now be described with reference to FIG. 5, FIG. 6 and FIG. 7. $D_n$ in FIG. 7 denotes the present parallel driving period data stored in the n-data latch 92. $D_{n+1}$ denotes the following parallel driving period data stored in the (n+1)-data register 91. $I_{Dm}$ and $V_{Dm}$ denote current and voltage waveforms, respectively, that flow through any one data electrode line to which a luminescence data voltage is applied in the parallel driving periods. $S_{Sn}$ denotes the scan driving signal applied from the scan driving unit 6 to an n-scan electrode line, and $S_{Sn+1}$ denotes the scan driving signal applied to an (n+1)-scan electrode line.

The pulse of the parallel synchronous signal $H_{SYNC}$ falls at the point t1 in the n-parallel driving period T1. The comparator 96 outputs its output signal COMP_OUT at the rising point of the $H_{SYNC}$ pulse. COMP_OUT is logic "1" from the rising point of the $H_{SYNC}$ pulse to the following pulse rising point because the present parallel driving period data $D_n$, "FFh", and the following parallel driving period data $D_{n+1}$, "F0h", are different.

Additionally, since the prior preliminary charging control signal PRE is logic "1" in the preliminary charging stage t1~t21, the preliminary charging control signal PRE2 from the second AND gate 98 becomes logic "1". The preliminary charging control signal PRE2 is inputted to the preliminary charging switches 95 and the charging switches 25. Thus, the preliminary charging switches 95 are turned off, which disconnects the signal input terminals of the data electrode lines 3 from the data driving unit 9. Further, the charging switches 25 are turned on, which connects the other terminals of the data electrode lines 3 to one another. Consequently, the parasitic capacitance of the electroluminescence cells 1 in the (n−1)-scan electrode line, which were previously lit in the prior parallel driving period scan stage, is discharged, resulting in increased potential of the data electrode lines above ground potential. In the preliminary charging stage t1~t21, a second potential is applied to the scan electrode lines 4 by the scan switches 10*a* through 10*c*.

In the scan stage t21~t3 of the n-parallel driving period T1, the prior preliminary charging control signal PRE is logic "0", therefore, the preliminary charging control signal PRE2 from the second AND gate 98 becomes logic "0". Consequently, the other terminals of the data electrode lines 3 are disconnected from one another by the charging switches 25, and the signal input terminals of the data electrode lines 3 are connected to the data driving unit 9. Furthermore, the ground potential, as the first potential which is lower than the second potential, is applied to the n-scan electrode line, which will be scanned, and the second potential is applied to the other scan electrode lines. The data current signals are applied to the signal input terminals of the data electrode lines 3.

In the peak booting stage t21~t22 of the scan stage t21~t3, the comparator 96 output signal COMP_OUT is logic "1" and the prior peak booting control signal PEAK is logic "1". Consequently, the peak booting control signal PEAK2 from the first AND gate 97 becomes logic "1". Since the peak booting control signal PEAK2 is inputted to the booting circuit 94, additional current signals are applied to the signal input terminals of the data electrode lines 3.

The parallel synchronous signal $H_{SYNC}$ falls at the point t3 of the (n+1)-parallel driving period T2. As noted above, COMP_OUT is outputted at the rising point of the $H_{SYNC}$ pulse. Therefore, COMP_OUT is logic "0" from the rising point of the $H_{SYNC}$ pulse to the following $H_{SYNC}$ pulse rising point because the present parallel driving period data $D_n$, "F0h", and the following parallel driving period data $D_{n+1}$, "F0h", are the same.

Accordingly, even when the prior preliminary charging control signal PRE is logic "1" in the preliminary charging stage t3~t41, the preliminary charging control signal PRE2 from the second AND gate 98 becomes logic "0". Since the preliminary charging control signal PRE2 is inputted to the preliminary charging switches 95 and the charging switches 25, the preliminary charging operation is not performed. Also, in the preliminary charging stage t3~t41, the second potential for preventing the electroluminescence cells 1 from emitting light is applied to the scan electrode lines 4 by the scan switches 10*a* through10*c*.

In the scan stage t41~t5 of the (n+1)-parallel driving period T2, the ground potential, as the first potential which is lower than the second potential, is applied to the (n+1)-scan electrode, which will be scanned, and the second potential is applied to the other scan is electrode lines. Additionally, the data current signal is applied to the signal input terminals of the data electrode lines 3.

In the peak booting stage t41~t42 of the scan stage t41~t5, the output signal COMP_OUT is logic "0". Accordingly, the peak booting control signal PEAK2 from the first AND gate 97 becomes logic "0" even when the prior peak booting control signal PEAK is logic "1". Since the peak booting control signal PEAK2 is input to the booting circuit 94, the peak booting operation is not performed.

According to the above-described method, the preliminary charging stage and the peak booting stage are performed in the following parallel driving period only when there is a predetermined difference between the present parallel driving period data and the following parallel driving period data. Thus, the preliminary charging stage and the peak booting stage may prevent a drop in brightness caused by parasitic capacitance of the electroluminescence cells and reduce power consumption. The preliminary charging stage and the peak booting stage may not be required in the following parallel driving period when there is less than the predetermined difference between the present parallel driving period data and the following parallel driving period data for at least the reasons noted below.

Without the preliminary charging stage and the peak booting stage occurring, the drop in brightness may happen when, in one data electrode line, the present parallel driving period data is low and the following parallel driving period data is high. In this case, the amount of charges for charging the parasitic capacitance of the electroluminescence cell corresponding to the following parallel driving period, in a reverse direction, in the present parallel driving period, is increased.

On the other hand, when the difference between the present parallel driving period data and the following parallel driving period data is small, or non-existent, the amount of charges for charging the parasitic capacitance of the electroluminescence cell corresponding to the following parallel driving period, in the reverse direction, in the present parallel driving period, is inversely proportional to the following parallel driving period data. The amount of charges for charging the parasitic capacitor of the electroluminescence cell corresponding to the following parallel driving period is referred to as a brightness drop rate, and the following parallel driving period data is referred to as a gray scale. In other words, as the gray scale increases, the brightness drop rate decreases, and vice versa. As a result, in an exemplary embodiment of the present invention, even without the preliminary charging stage and the peak booting stage occurring, a brightness drop may not exist.

It will be apparent to those skilled in the art that various modifications and variation can be made in the present invention without departing from the spirit or scope of the invention. Thus, it is intended that the present invention cover the modifications and variations of this invention provided they come within the scope of the appended claims and their equivalents.

What is claimed is:

1. A method for driving an electroluminescence display panel, comprising:

performing a preliminary charging stage, in an initial stage of a parallel driving period, in which signal input terminals of data electrode lines are disconnected from a data driving unit, and other terminals of the data electrode lines are connected to one another; and performing the preliminary charging stage in a following parallel driving period only when data of a present parallel driving period and data of the following parallel driving period are different, wherein the preliminary charging stage is performed in the following parallel driving period only when a difference between the data of the present parallel driving period and the data of the following parallel driving period is greater than a reference value.

2. The method of claim 1, further comprising:

performing, after the preliminary charging stage is performed, a scan stage, until the end of each parallel driving period, for a scan electrode line that will be scanned.

3. The method of claim 2, wherein the scan stage comprises:

disconnecting the other terminals of the data electrode lines from one another;

connecting the signal input terminals of the data electrode lines to the data driving unit;

applying a first potential to the scan electrode line that will be scanned, and applying a second potential, which is higher than the first potential, to other scan electrode lines; and applying data current signals to the signal input terminals of the data electrode lines.

4. The method of claim 3, further comprising a peak booting stage in which additional current signals are applied to the signal input terminals at an initial stage of the scan stage.

5. The method of claim 4, wherein the peak booting stage is performed in the following parallel driving period only when the data of the present parallel driving period and the data of the following parallel driving period are different.

6. The method of claim 1, wherein when connecting the other terminals of the data electrode lines to one another in the preliminary charging stage, the other terminals of the data electrode lines are also connected to a cathode of a zener diode and a first potential is applied to an anode of the zener diode.

7. A method for driving an electroluminescence display panel, comprising:

performing a preliminary charging stage, in an initial stage of a parallel driving period, in which signal input terminals of data electrode lines are disconnected from a data driving unit, and other terminals of the data electrode lines are connected to one another;

performing the preliminary charging stage in a following parallel driving period only when data of a present parallel driving period and data of the following parallel driving period are different;

performing, after the preliminary charging stage is performed, a scan stage, until the end of each parallel driving period, for a scan electrode line that will be scanned, wherein the scan stage comprises:

disconnecting the other terminals of the data electrode lines from one another, connecting the signal input terminals of the data electrode lines to the data driving unit, applying a first potential to the scan electrode line that will be scanned, and applying a second potential, which is higher than the first potential, to other scan electrode lines, and applying data current signals to the signal input terminals of the data electrode lines; and performing a peak booting stage in which additional current signals are applied to the signal input terminals at an initial stage of the scan stage, wherein the peak booting stage is performed in the following parallel driving period only when the data of the present parallel driving period and the data of the following parallel driving period are different and a difference between the data of the present parallel driving period and the data of the following parallel driving period is greater than a reference value.

8. A data driving unit for an electroluminescence display panel, comprising:

a (n+1)-data register coupled to a n-data latch and a comparator;

a digital to analog converter coupled to the n-data latch and the comparator;

a booting circuit coupled to the digital to analog converter; and a preliminary charging switch coupled to the booting circuit;

wherein the comparator outputs to an AND gate that outputs to the booting circuit;

wherein the comparator outputs to an AND gate that outputs to the preliminary charging switches.

* * * * *